United States Patent [19]

Larkfeldt et al.

[11] 3,987,713

[45] Oct. 26, 1976

[54] AIR JET NOZZLE AND SYSTEM

[75] Inventors: Birger Larkfeldt, Odensjo-Barnarp; Lennart Widerby, Jonkoping, both of Sweden

[73] Assignee: Aktiebolaget Svenska Flaktfabriken, Näcka, Sweden

[22] Filed: Feb. 21, 1975

[21] Appl. No.: 551,757

[30] Foreign Application Priority Data

Feb. 25, 1974 Sweden ..... 7402503

[52] U.S. Cl. ..... 98/40 N; 239/598

[51] Int. Cl.[2] ..... F24F 13/02

[58] Field of Search ..... 98/40 D, 40 N, 40 V; 239/598; 181/48, 59

[56] References Cited

UNITED STATES PATENTS

| | | | |
|---|---|---|---|
| 2,103,810 | 12/1937 | Caspar | 181/59 |
| 2,126,230 | 8/1938 | Troxell, Jr. | 98/40 D X |
| 2,245,470 | 6/1941 | Fuchs | 98/40 D X |
| 3,055,145 | 9/1962 | Lindsay | 98/40 N X |
| 3,760,708 | 9/1973 | Burup | 98/40 D X |

FOREIGN PATENTS OR APPLICATIONS

| | | | |
|---|---|---|---|
| 1,102,371 | 3/1961 | Germany | 98/40 N |

*Primary Examiner*—William E. Wayner
*Assistant Examiner*—William E. Tapolcai, Jr.
*Attorney, Agent, or Firm*—Howson and Howson

[57] ABSTRACT

A low-noise nozzle system for receiving an air flow from a relatively low-velocity, high-volume air source and for producing therefrom a high-velocity, low-volume jet of air for delivery into a room to control the distribution of air in the room. The nozzle inner walls first extend along a straight axis into the room, then bend gradually at right angles to feed an outlet aperture which injects the jet into the room at right angles to the axis. The aperture is in a plane parallel to said straight axis and elongated at right angles to said axis; low-noise delivery of the jet into the room is accomplished by special proportioning of the radii of the nozzle inner walls at the bend in relation to the size of the inlet to the nozzle, and of the size of the outlet aperture relative to the size of said nozzle inlet.

6 Claims, 5 Drawing Figures

$$\frac{1}{2} \geq \frac{R_{min}}{d_{equiv}} \geq \frac{1}{4}$$

$$1 \geq \frac{R_{mean}}{d_{equiv}} \geq \frac{1}{2}$$

$$10 \geq \frac{d^2_{equiv}}{A} \geq 5$$

AIR JET NOZZLE AND SYSTEM

Figure 1:
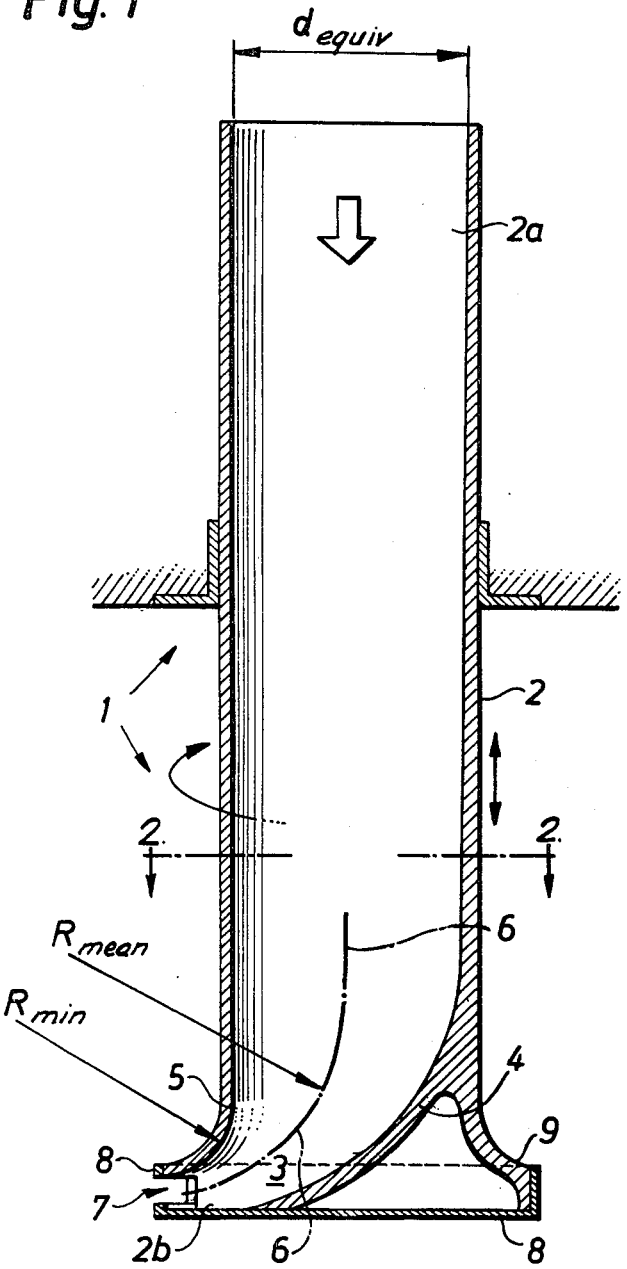

This invention relates to a new and improved construction of a jet nozzle for air which is intended for use in the ventilation of public rooms, working premises, industrial halls etc. to transport and/or distribute air to selected areas within said rooms etc. by causing the ventilation air supplied separately with low speed through one or more openings from a supply air duct to flow in the intended direction and/or be distributed within said rooms by means of a plurality of jet nozzles, each of which is designed so as with low sound level to deliver an air stream, which is small in relation to the air amount in the room etc., with high speed, which jet nozzles are so located and disposed relative to each other that the action ranges for the jet nozzles cover said room etc. to its entirety and, respectively, will be linked together to a number of preferably closed flow paths, and which jet nozzles are manually or automatically adjustable in any optional direction and provided with a variable outlet opening.

Methods of the aforesaid kind have now been utilized successfully at ventilation installations for directing the air in rooms of most different types by means of a small air stream within selected areas of a room (staying zone) in a way which is optimum from a comfort and, in the case of industrial premises, an efficiency point of view and thereby to render possible a correct and ample air circulation in the room, irrespective of where the primary supply air flow or primary-secondary air flow is passed into the room, and always to be able to maintain by simple means the desired primary air flow. It is, thus, no longer necessary to increase or decrease the primary air flow in order to accomplish the air movement, not even in such rooms as have a complicated shape from a flow-design viewpoint. The present invention relates to a device using jet nozzles for safely carrying out the aforesaid method with control or pilot air of the flow "jet" - type with a low sound level.

The invention is characterized in that the jet nozzle constitutes a pipe, which in relation to its connection at its inlet end to an air supply duct into said room is axially movable, and at its outer end is provided with an outlet which is softly rounded from its axis of symmetry to one side, in such a manner that a rear wall of the pipe, in relation to the outlet, is provided with a concave rounding, and an opposed wall of the pipe located adjacent the lateral outlet is provided with a convex rounding having a smaller radius of curvature to form on the side of the pipe an outward facing rectangular outlet opening having its long axis oriented perpendicularly to the axis of symmetry of the pipe, and that the jet nozzle - when the radius of curvature for a central line through the rounded outlet is designated by $R_{mean}$, the aforesaid smaller radius of curvature is designated by $R_{min}$, the cross-section of the inlet end of the pipe is designated by $d_{equiv.}$ and said outlet opening area is designated by A — is so designed that $$1 \geqslant \frac{R_{mean}}{d_{equiv}} \geqslant 1/2$$

$$1/2 \geqslant \frac{R_{min}}{d_{equiv}} \geqslant 1/4, \text{ and}$$

$$10 \geqslant \frac{d^2_{equiv}}{A} \geqslant 5$$

for the intended air supply with high speed through the jet nozzle with low sound level.

Further characterizing features of the invention become apparent from the attached claims.

Figure 2:
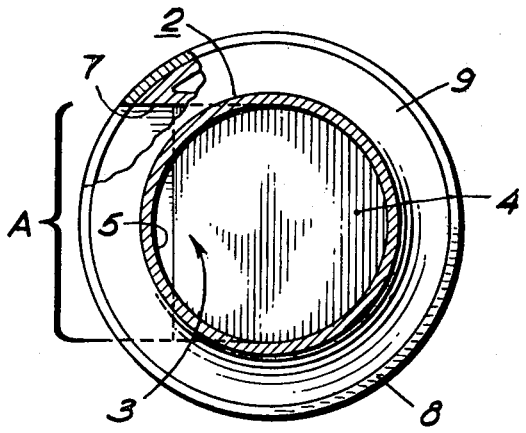
Figure 3A:
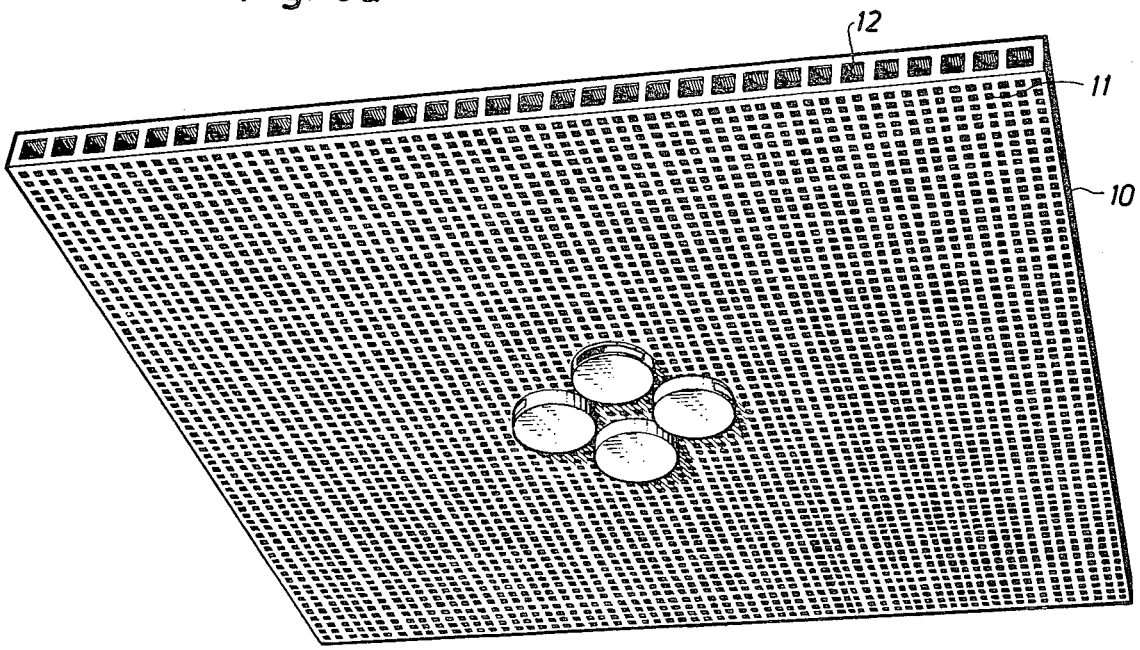
Figure 3B:
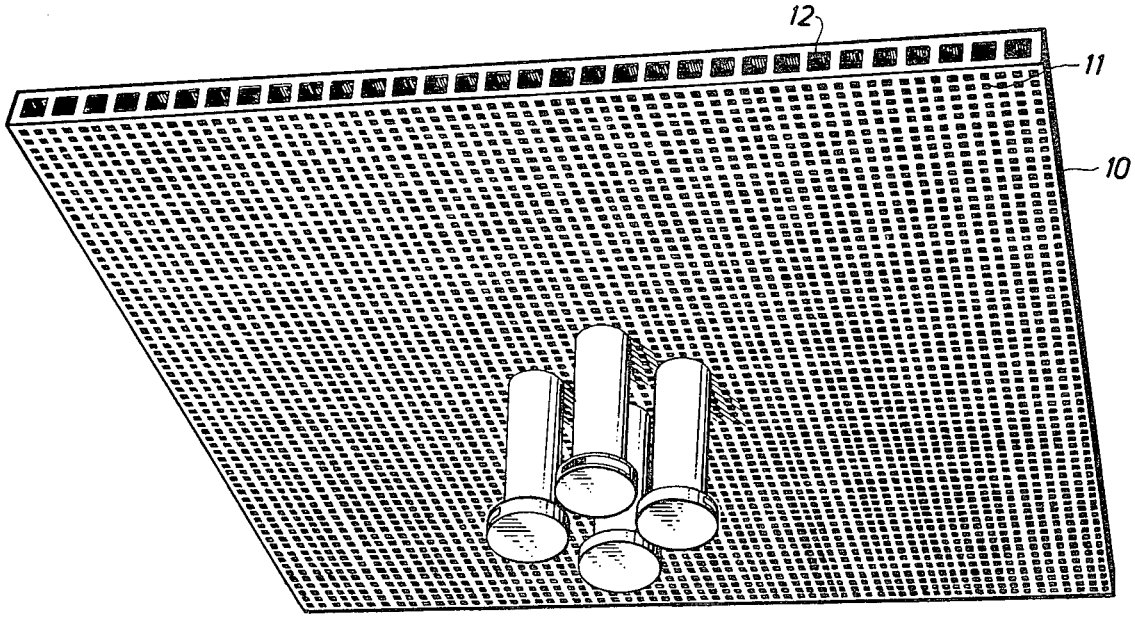

The invention is described in greater detail in the following, with reference to the accompanying drawings, in which FIG. 1 is a longitudinal section through a jet nozzle, FIG. 2 is a cross-section through the same, taken along lines 2—2 of FIG. 1 and FIGS. 3A,3B shows jet nozzles applied to a supply air device.

Figure 4:
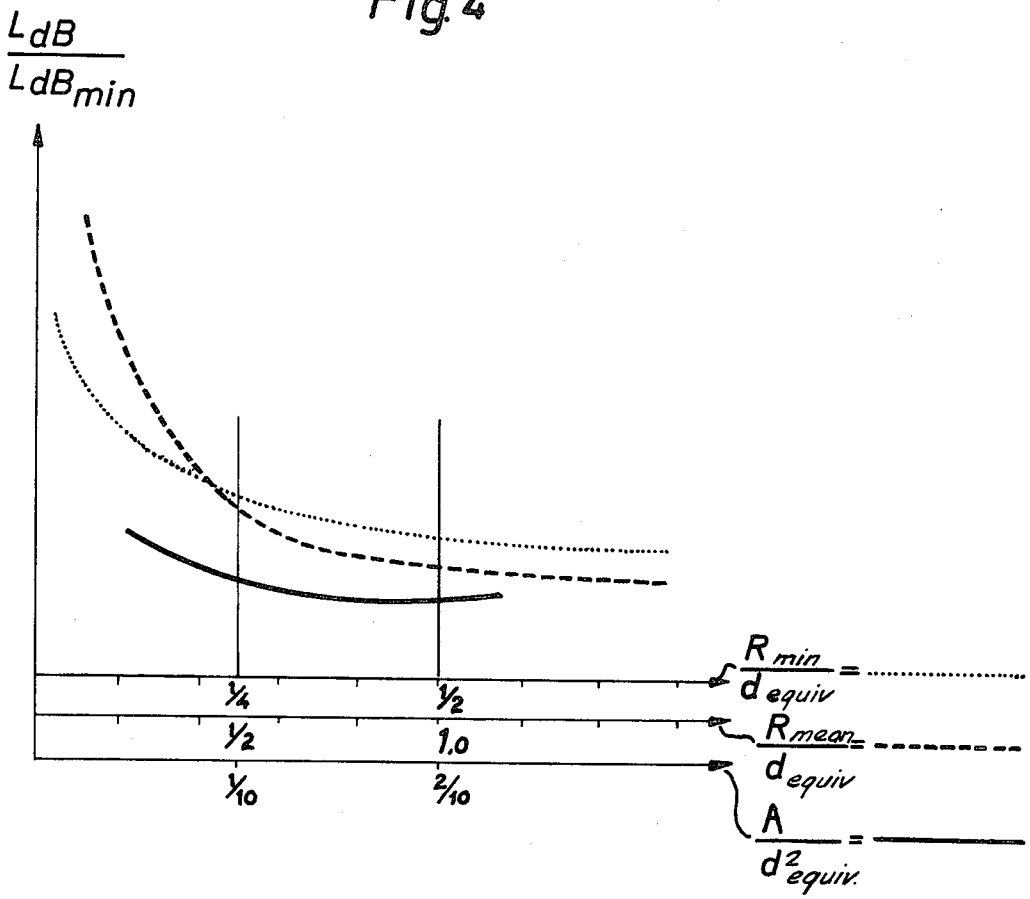

FIG. 4 shows three explanatory curves indicative of the limits for the three above mentioned relationships, the last one being inverted from a practical view-point.

In the Figures, 1 designates in general a jet nozzle formed as a long and narrow pipe 2, the inlet end of which is designated by **2*a* and the outlet end by 2*b*. Adjacent its outlet end the jet nozzle is provided with a laterally directed outlet 3. An outlet opening is designated by 7 and has the form of a long and narrow rectangular slot, the size of which is designated schematically by A. The size A is continuously variable by moving in lateral direction a rotatable cover 8 covering the outer end of the jet nozzle. Said cover is provided with a collar, which encloses a drawn-out shoulder 9 of the pipe 2 and the outlet opening 7 located on the opposed side. Said collar of the cover is provided with a cutout of the same size A as said outlet opening. By rotating the cover, a greater or smaller portion of the outlet opening 7 is exposed or shielded. This is shown schematically in FIG. 2. The jet nozzle is axially movable, as shown by arrows, and may also be rotatable about its axis of symmetry in the same manner as described previously in conjunction with an earlier embodiment of a supply air device according to Swedish Pat. No. 349 136. Also other embodiments of supply air devices are known which render possible a directional change by turning and, respectively, changing the height position for a supplied air jet. Said devices, however, have proved unapplicable to the special problem to be solved by the present invention, viz. to supply air at a pressure of the magnitude 200 Pa without giving rise to a disturbing sound level. In order to safely meet the high requirements on the intended air supply with high speed and low sound level in installations of the aforesaid kind, the jet nozzle shall be designed so that the ratio of the radius of curvature $R_{mean}$ for a central line through the rounded outlet 3 and, respectively, the radius of curvature $R_{min}$ for a lip of the pipe 2 at the outlet 7 to the cross-sectional dimension $d_{equiv}$ at the inlet end 2*a*** of the pipe, shall be $\geqslant$ ½ and, respectively, $\geqslant$ ¼, and the relation between the square of said cross-sectional dimension and the area A of the rectangular, laterally directed outlet opening shall be $\geqslant$ 5.

In FIGS. 3A and 3B a case is shown in which jet nozzles are mounted projecting from the surface and in the centre of an air supply device 10 of a kind previously known through Swedish Pat. No. 334 991. 11 designates here the perforated cover of the pressure box, and 12 designates outlet openings along one or more walls of the supply air device. The jet nozzles in FIG. 3B are axially projecting downwards in order to control and transport air below a possible obstacle in the room, for example a roof beam or a light fitting. The jet nozzles, of course, are also in this application case rotatable.

In FIG. 4 the vertical scale, the ordinate, represents $$\frac{L_{dB}}{L_{dB}}$$

i.e. sound level L in decibel in relation to the sound level minimum for the three magnitudes of the horizontally-plotted parameters, i.e.

$$\frac{R_{min}}{d_{equiv}},$$

$$\frac{R_{min}}{d_{equiv}}$$

and $$\frac{A}{d^2_{equiv}},$$

the last magnitude being an inversion of $$\frac{d^2_{equiv}}{A}.$$

This will facilitate the comparison of the three curves with one another in one and the same drawing figure. As illustrated the curve for the relation $$\frac{A}{d^2_{equiv}}$$

has a minimum in $$\frac{L_{dB}}{L_{dB}}$$

between the values 1/10 and 2/10. These limits are therefore practical, useful values for the configuration and construction of the air jet nozzle according to this invention.

We claim:

1. A room-air distributing air-jet nozzle system for the quiet injecting of a high-velocity low-volume air jet into the air of a room to control the distribution and flow of said room air, comprising:

a long straight pipe having an inlet end for receiving an inlet air flow, having an air-transporting central portion with a substantially straight axis of symmetry for receiving and conveying said air flow, and having an outlet portion responsive to said air flow from said central portion to form said jet and deliver it to said room;

said outlet portion comprising a closure extending generally across the outlet end of said pipe, and an air outlet aperture facing substantially radially outward with respect to said axis of symmetry for directing said jet into said room substantially at right angles to said axis;

said air outlet having a cross-sectional dimension extending substantially at right angles to said axis;

a first part of the inner wall of said closure portion being turned smoothly outwardly with a radius of curvature $R_{min}$, the upper boundary of said aperture being formed by the terminal portion of said outwardly-turned first part of said inner wall;

said outlet portion having a second inner wall part, on the opposite side of the interior thereof from said outlet aperture, which second inner wall part is smoothly concave toward said outlet aperture;

a line extending from said axis of symmetry of said central pipe portion to the center of said aperture along points midway between said first and second wall parts having a radius of curvature $R_{mean}$;

said nozzle being configured so that the ratio $R_{mean}/d_{equiv}$ has a value from ½ to 1 inclusive, the ratio $R_{min}/d_{equiv}$ has a value from ¼ to ½ inclusive, and the ratio $d^2_{equiv}/A$ has a value from 5 to 10 inclusive;

wherein $d_{equiv}$ is the equivalent cross-sectional inner diameter of said inlet end of said pipe, and A is the area of said outlet aperture.

2. The system of claim 1, comprising means for adjusting the effective area of said outlet aperture.

3. The system of claim 2, wherein said adjusting means comprises a cap member having a control aperture in the sidewall thereof and rotatable about the outlet end of said nozzle to align said control aperture to a variable extent with said outlet aperture.

4. The system of claim 1, comprising means slidably mounting said nozzle for adjustment to varying distances into said room.

5. The system of claim 1, comprising main air supply means having openings for introducing a flow of air into said room, said openings having a total area large compared with said outlet area of said nozzle, and means mounting said nozzle to project from a part of said main air supply means within the portion thereof containing said openings.

6. The system of claim 5, wherein said nozzle is axially positionable with respect to said main air supply means, is rotatable about its axis, and is adjustable as to said area of said outlet aperture.

* * * * *